US006682243B2

(12) United States Patent
Iwamoto et al.

(10) Patent No.: US 6,682,243 B2
(45) Date of Patent: Jan. 27, 2004

(54) BAR-LIKE PAINT DELIVERING CONTAINER

(75) Inventors: Yoichi Iwamoto, Tokyo (JP); Hisao Iwamoto, Ichikawa (JP); Koji Nishikawa, Yamatotakada (JP)

(73) Assignee: Kanebo, Ltd., Tokyo (JP)

( * ) Notice: Subject to any disclaimer, the term of this patent is extended or adjusted under 35 U.S.C. 154(b) by 0 days.

(21) Appl. No.: 10/111,662

(22) PCT Filed: Jun. 20, 2001

(86) PCT No.: PCT/JP01/05291

§ 371 (c)(1),
(2), (4) Date: Aug. 20, 2002

(87) PCT Pub. No.: WO01/97649

PCT Pub. Date: Dec. 27, 2001

(65) Prior Publication Data

US 2003/0042161 A1 Mar. 6, 2003

(30) Foreign Application Priority Data

Jun. 22, 2000 (JP) ..... 2000-187204

(51) Int. Cl.[7] ..... B43K 21/08
(52) U.S. Cl. ..... 401/75; 401/76; 401/77
(58) Field of Search ..... 401/75–78, 70, 401/68, 88

(56) References Cited

U.S. PATENT DOCUMENTS 3,771,881 A * 11/1973 Swenson ..... 401/75
6,561,711 B1 * 5/2003 Pierpont ..... 401/78

FOREIGN PATENT DOCUMENTS

| | | |
|---|---|---|
| JP | 2522342 | 10/1996 |
| JP | 09-215522 | 8/1997 |
| JP | 10-085039 | 4/1998 |
| JP | 10-108728 | 4/1998 |
| JP | 11-018830 | 1/1999 |

* cited by examiner

*Primary Examiner*—Tuan N. Nguyen
(74) *Attorney, Agent, or Firm*—Hogan & Hartson, LLP

(57) ABSTRACT

The invention provides a stick-shaped cosmetic screw-out container including a holding cylinder fitting and holding a stick-shaped cosmetic and having a screwing projection provided from a side wall. The container also includes a shell cylinder including the holding cylinder vertically slidably, having a guide groove through which the screwing projection penetrates provided on a side wall and having an engagement concave portion provided on a lower side wall. The container further includes a sleeve fitted in the shell cylinder, having a screwing groove for screwing the screwing projection provided on an inner wall and having, on a lower inner wall, an inner peripheral rib engaged rotatably with the engagement concave portion so as not to be dropped out, a body cylinder for holding a lower portion of the shell cylinder so as not to be dropped out, and a fitting cylinder fixed onto the body cylinder and provided with a fitting portion in which a cap is removably fitted. The container is made such that at least one of the holding cylinder, the shell cylinder and the sleeve is formed of a different material. The lower portion of the shell cylinder is connected to the body cylinder unrotatably and removably so as not to be dropped out. The shell cylinder is divided into an upper shell cylinder and a lower shell cylinder. The upper shell cylinder is provided with the guide groove. A diameter increasing portion having an outside diameter increased is provided in a lower portion. A pair of window portions are provided in the vicinity of a lower end in a horizontal direction and a tongue piece-shaped inserting portion to enter from the lower end of the upper shell cylinder is linked to the lower shell cylinder. A hook is protruded from the window portion to an outside over a side wall of a tip portion of the inserting portion, and one of end faces of the hook is cut like a taper to constitute a cam portion, and in such a state that the hook is protruded from the window portion of the upper shell cylinder. The engagement concave portion is formed under the hook, and the hook is retracted into the window portion by the cam portion of the hook and is disengaged from the engagement concave portion when the upper shell cylinder and the lower shell cylinder are rotated relatively in a direction of the cam portion.

20 Claims, 9 Drawing Sheets

BAR-LIKE PAINT DELIVERING CONTAINER

BACKGROUND OF THE INVENTION

1. Field of the Invention

The present invention relates to a stick-shaped cosmetic screw-out container to be used by screwing out (hereinafter sometimes referred to as "taking out") a stick-shaped cosmetic such as a lipstick or a lip cream from a container.

2. Description of the Related Art

Conventionally, a stick-shaped screw-out container for a lipstick is constituted by a holding cylinder holding a stick-shaped cosmetic, a shell cylinder having the holding cylinder provided therein vertically slidably, a sleeve rotatably held in the shell cylinder and having a spiral groove provided on an inner wall, a body cylinder having a lower portion of the shell cylinder fixed thereto, and a fitting cylinder fixed to an upper end of the body cylinder in which a cap is removably fitted. This kind of container is fixed firmly so as not to be carelessly disassembled during use. Moreover, a member constituting the screw-out container is formed of various materials such as a resin material or a metal material in respect of a function and a decoration.

In recent years, however, the disposal of wastes which are increased every year and the drain of the resources of the earth have constituted a social problem and the necessity of controlling the amount of discharge of refuse and promoting the recycle of refuse has been increased. For this reason, the refuse has been separated selectively in more self-governing communities and manufactures must also recycle a container or a packaging material in accordance with a container and packaging material recycle method. In the stick-shaped cosmetic container described in the related art, however, it is assembled firmly so as not to be disassembled carelessly. When disposing of a used container, therefore, synthetic resin wastes and metal wastes cannot be separated and a countermeasure cannot be taken against the separation disposal.

Conventional container have proposed such a structure that a structure portion including a holding cylinder, a shell cylinder and a sleeve is constituted removably from an outer shell member including a body cylinder, a fitting cylinder and a cap (like a cartridge type container) so that the outer shell member can be separated from the structure portion, and furthermore, a concave groove is provided on the shell cylinder of the structure and an inner peripheral rib to be rotatably engaged with the concave groove is provided on the inner periphery of the sleeve.

In the former structure, a cut portion which can be forcibly removed is provided in a part of the concave groove on the side surface of the shell cylinder. When the sleeve is forcibly removed, the shell cylinder is deformed so that the concave groove and the inner peripheral rib can be disengaged from each other. In the latter structure, moreover, a nick is provided across the concave groove from the lower end of the shell cylinder and the nick is held to throttle the concave groove portion inwardly so that the concave groove and the inner peripheral rib can be disengaged from each other. The holding cylinder and the shell cylinder which are often formed of a resin material can be separated from the sleeve which is often formed of a metal material.

In the former structure, however, in the case in which the holding cylinder is provided on the inside of the concave groove, the shell cylinder can be prevented from being deformed. If the holding cylinder is slightly shifted from the concave groove, the shell cylinder can be deformed. Therefore, there is a possibility that the sleeve might be removed carelessly. In other words, when the structure portion is to be taken out from the outer shell member, the sleeve is held depending on the position of the holding cylinder. However, only the sleeve is taken out so that there is a possibility that the structure portion cannot be taken out. For this reason, the deformation strength of the shell cylinder and the engagement strength of the structure portion are balanced with more difficulty.

In the latter structure, moreover, when the structure portion is engaged with the outer shell member, the lower portion of the shell cylinder is not throttled inwardly. Therefore, it is not necessary to balance the deformation strength of the shell cylinder with the engagement strength of the structure portion. In the state of the structure portion, however, the nick of the shell cylinder should be held to throttle the concave groove portion inwardly. Therefore, some force is required so that there is a possibility that some women cannot carry out an operation.

SUMMARY OF THE INVENTION

It is an advantage to obtain a stick-shaped cosmetic screw-out container which can be disassembled easily and scraped separately, and furthermore, can be prevented from being disassembled carelessly during use.

In order to solve the problems, the invention provides a stick-shaped cosmetic screw-out container including a holding cylinder fitting and holding a stick-shaped cosmetic and having a screwing projection provided from a side wall. The container also includes a shell cylinder including the holding cylinder vertically slidably, having a guide groove through which the screwing projection penetrates provided on a side wall and having an engagement concave portion provided on a lower side wall. The container further includes a sleeve fitted in the shell cylinder, having a screwing groove for screwing the screwing projection provided on an inner wall and having, on a lower inner wall, an inner peripheral rib engaged rotatably with the engagement concave portion so as not to be dropped out, a body cylinder for holding a lower portion of the shell cylinder so as not to be dropped out, and a fitting cylinder fixed onto the body cylinder and provided with a fitting portion in which a cap is removably fitted.

The container is made such that at least one of the holding cylinder, the shell cylinder and the sleeve is formed of a different material. The lower portion of the shell cylinder is connected to the body cylinder unrotatably and removably so as not to be dropped out. The shell cylinder is divided into an upper shell cylinder and a lower shell cylinder. The upper shell cylinder is provided with the guide groove. A diameter increasing portion having an outside diameter increased is provided in a lower portion. A pair of window portions are provided in the vicinity of a lower end in a horizontal direction and a tongue piece-shaped inserting portion to enter from the lower end of the upper shell cylinder is linked to the lower shell cylinder. A hook is protruded from the window portion to an outside over a side wall of a tip portion of the inserting portion, and one of end faces of the hook is cut like a taper to constitute a cam portion, and in such a state that the hook is protruded from the window portion of the upper shell cylinder. The engagement concave portion is formed under the hook, and the hook is retracted into the window portion by the cam portion of the hook and is disengaged from the engagement concave portion when the upper shell cylinder and the lower shell cylinder are rotated relatively in a direction of the cam portion.

Figure 1:
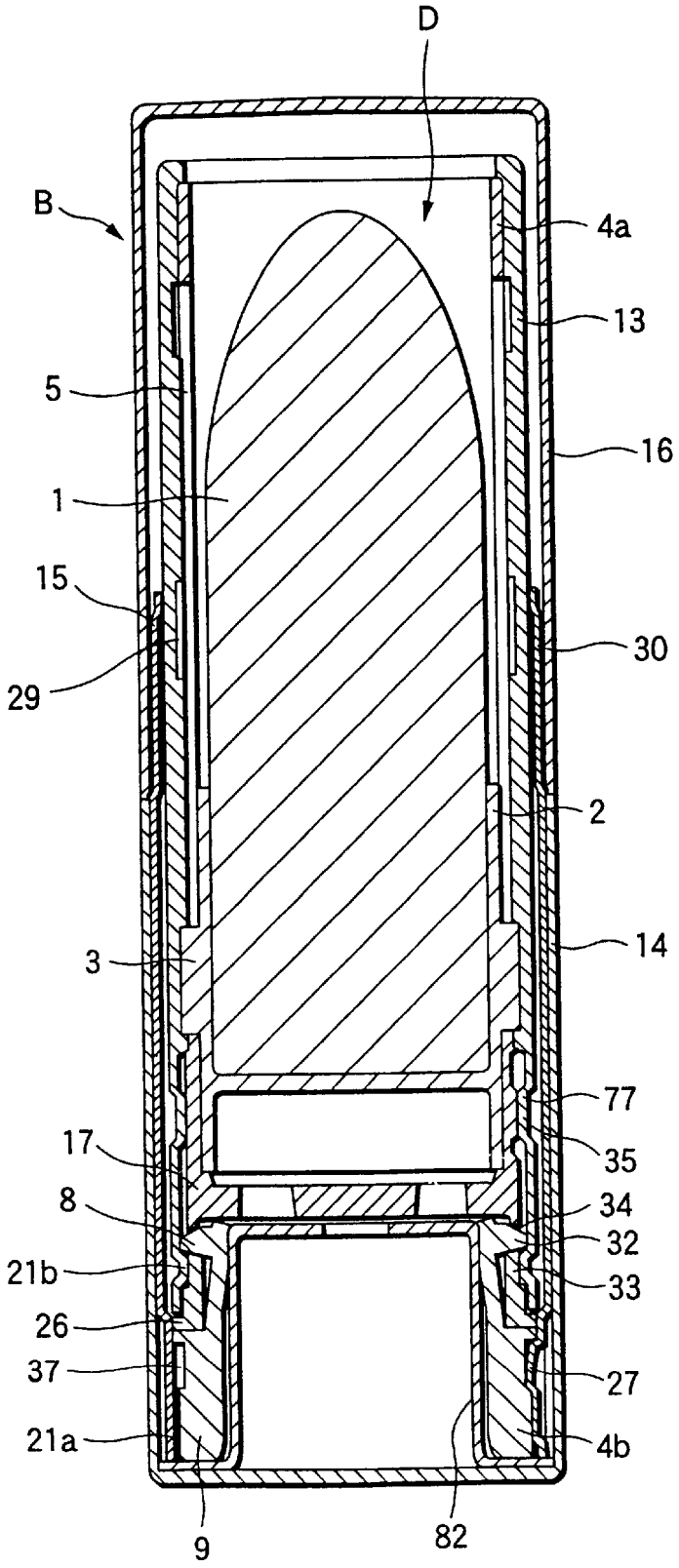
FIG. 1 is a front sectional view showing a stick-shaped cosmetic screw-out container according to an embodiment of the invention.
Figure 2:
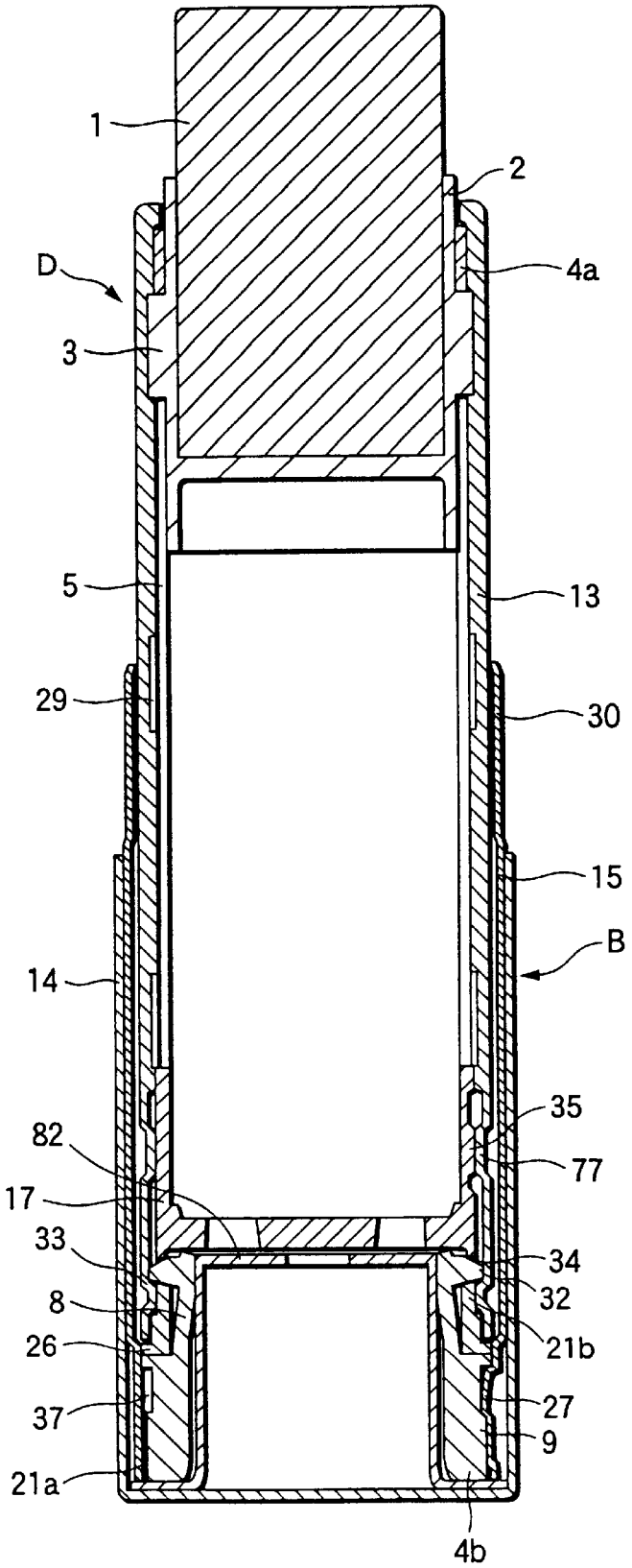
FIG. 2 is a front sectional view showing a state in which a stick-shaped cosmetic of the stick-shaped cosmetic screw-out container according to the embodiment of the invention is taken out.
Figure 3:
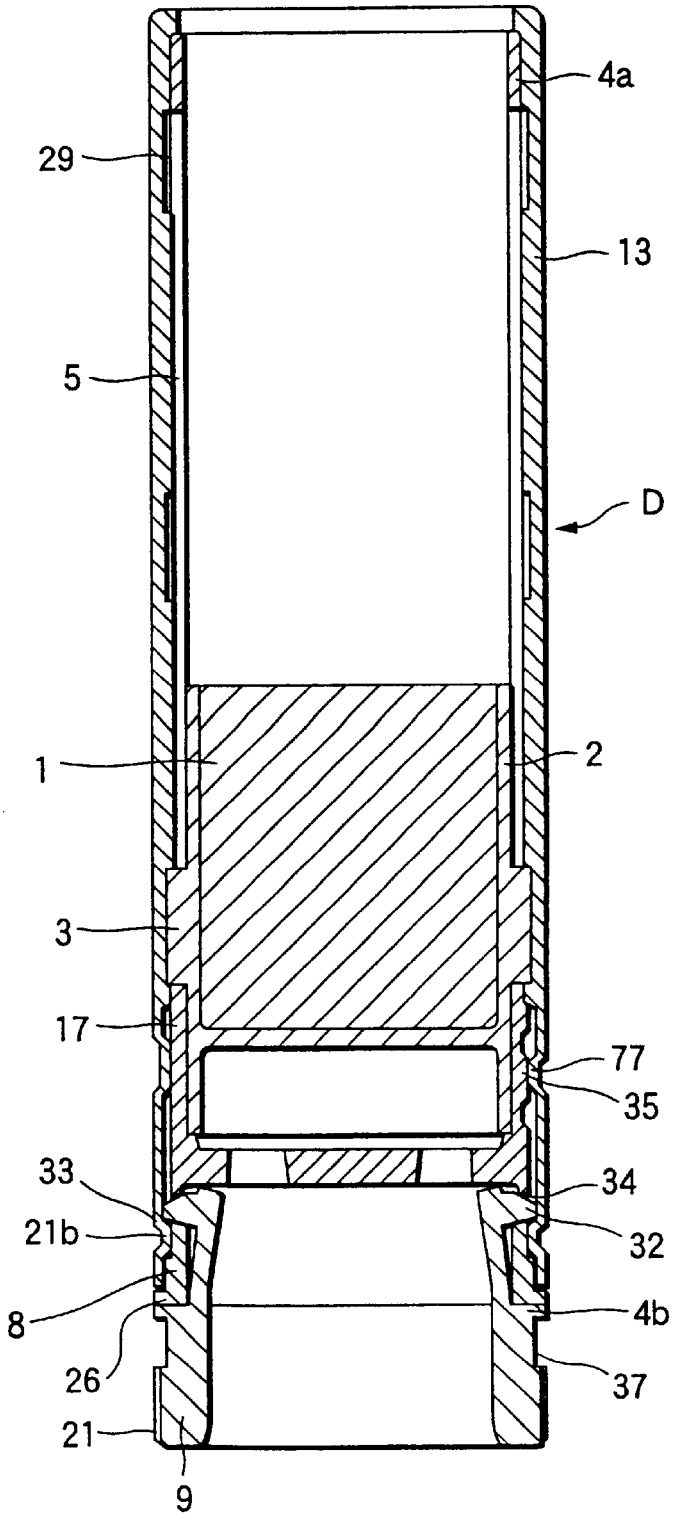
FIG. 3 is a front sectional view showing a structure portion in a normal state.
Figure 4:
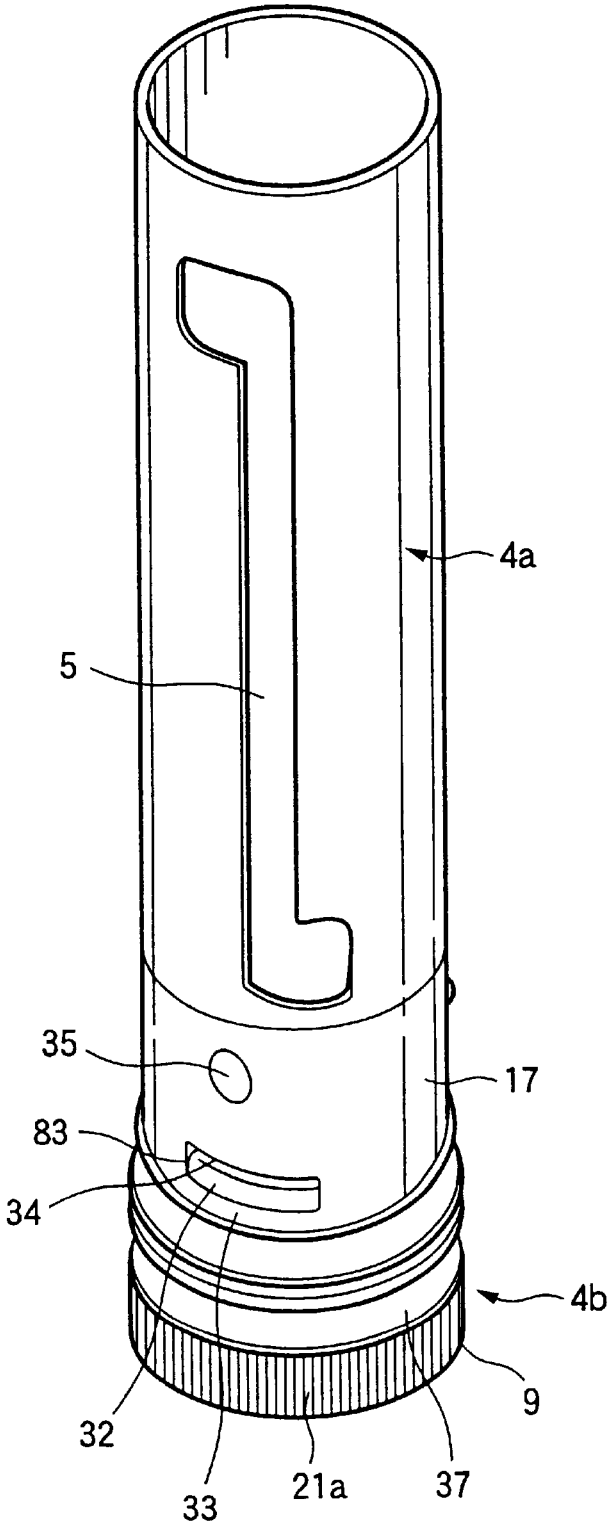
FIG. 4 is a perspective view showing a shell cylinder in the normal state.
Figure 5:
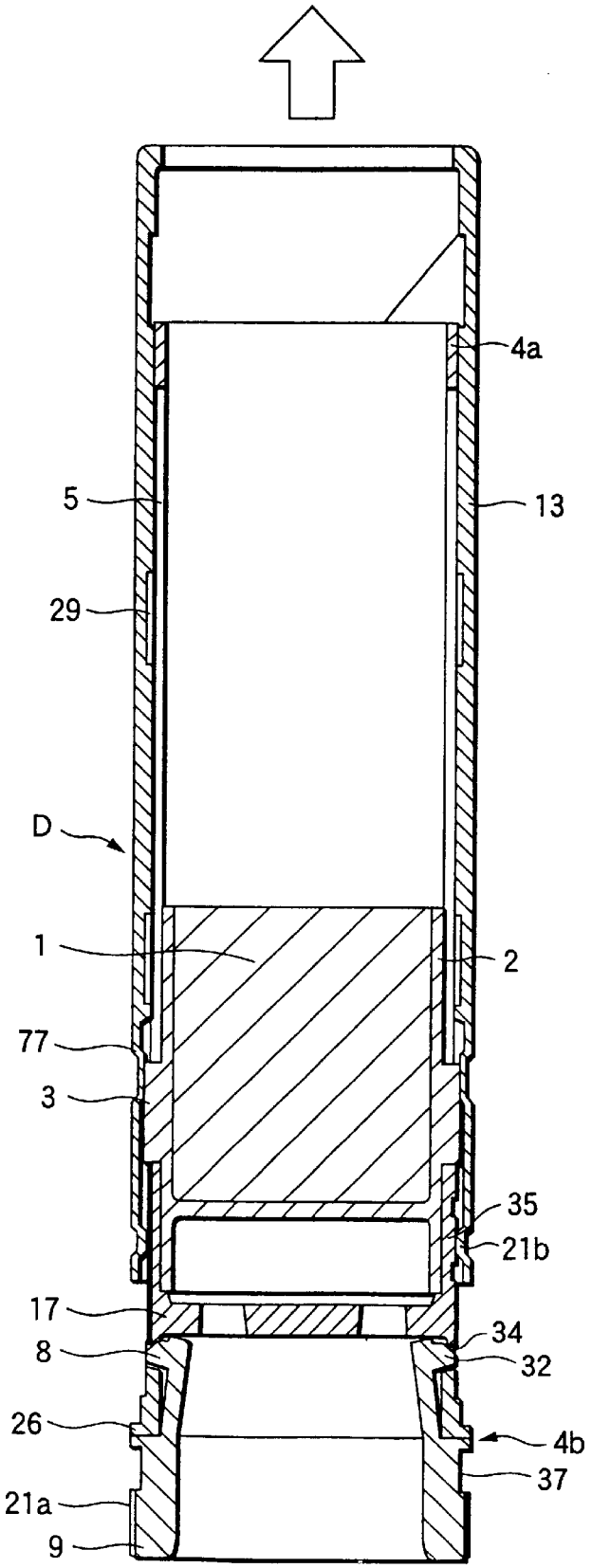
FIG. 5 is a front sectional view showing a structure portion in a disassembly state.
Figure 6:
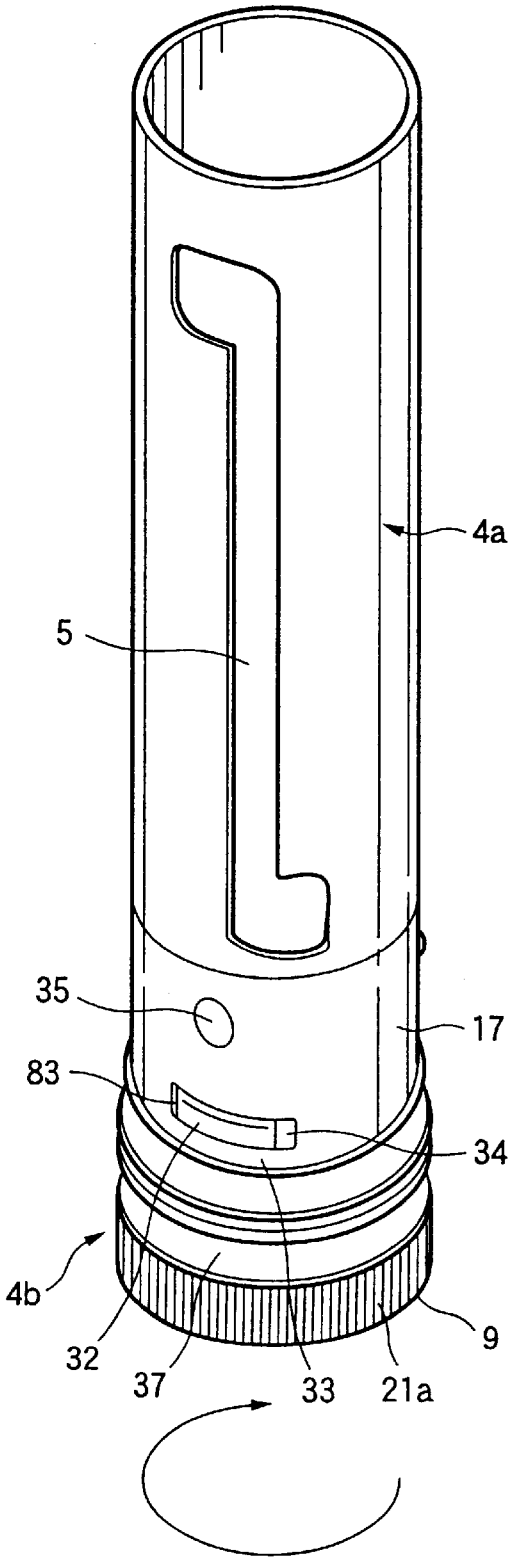
FIG. 6 is a perspective view showing a shell cylinder in the disassembly state.
Figure 7A:
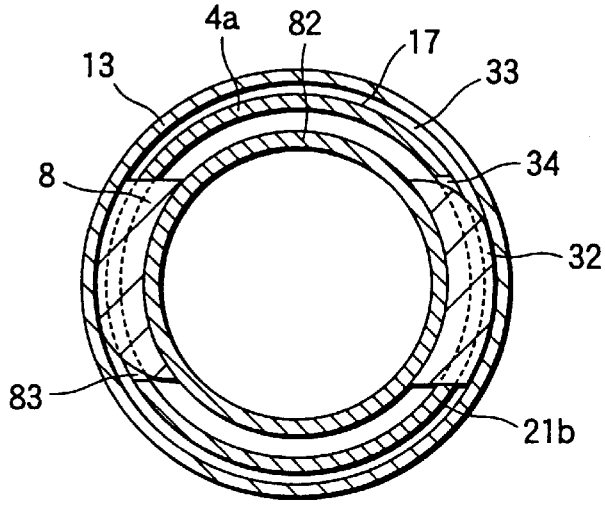
FIG. 7 is a sectional view showing a hook portion, (a) being a sectional view showing a state in which the structure portion is attached to a container body, (b) being a sectional view showing a state of a single structure portion, and (c) being a sectional view showing a disassembly state.
Figure 7B:
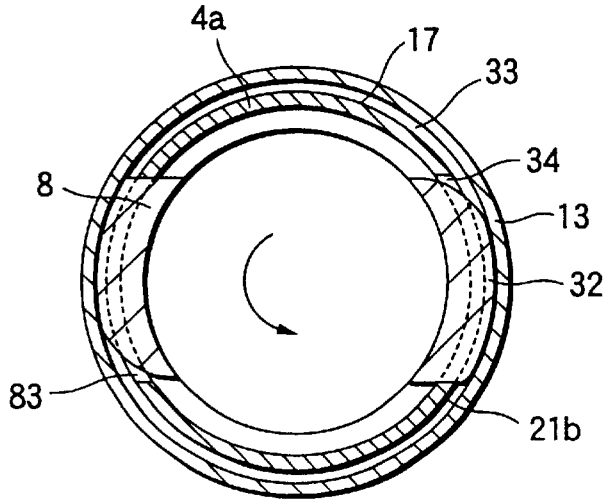
Figure 7C:
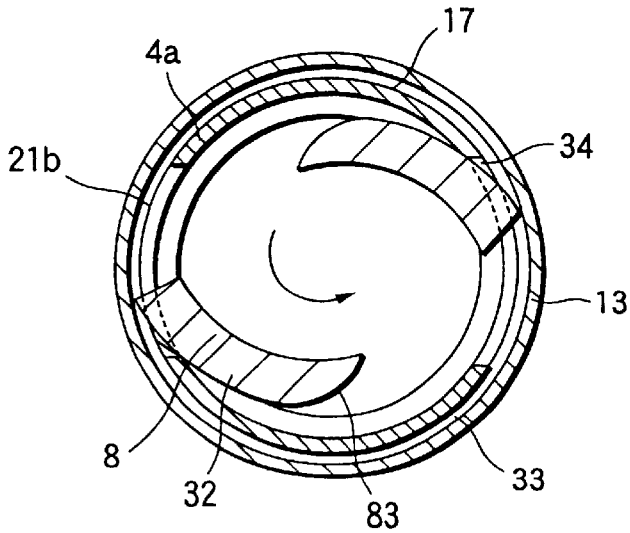
Figure 8:
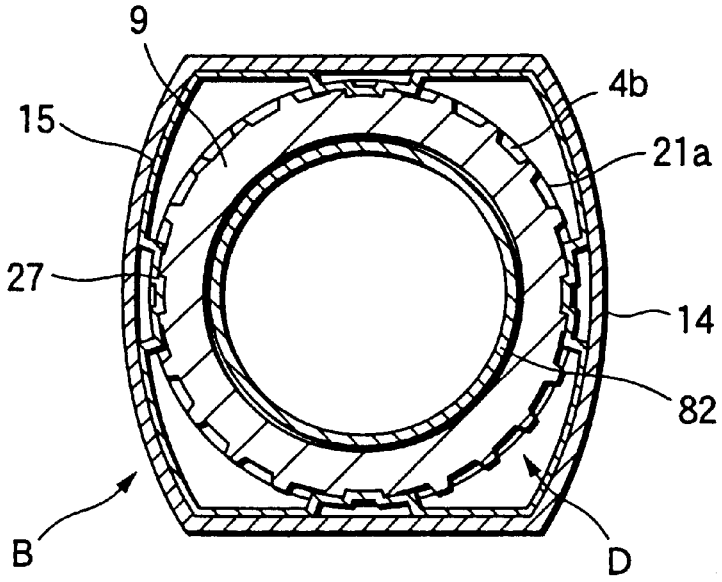
FIG. 8 is a sectional view showing a base portion of a lower shell cylinder.
Figure 9:
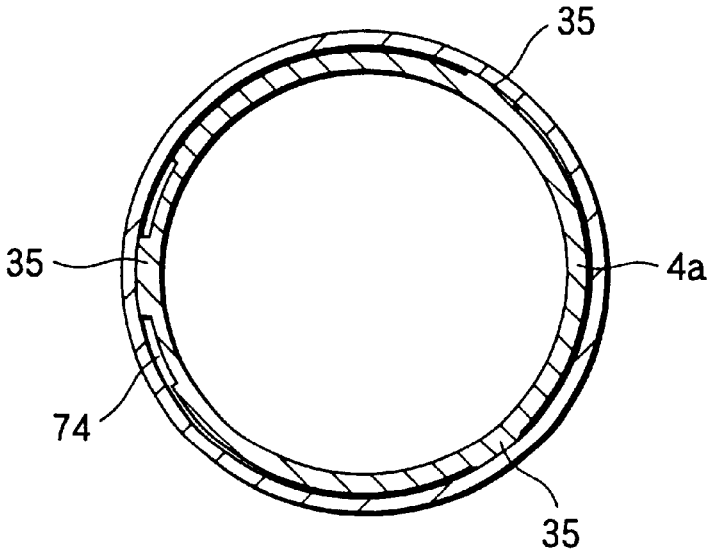
FIG. 9 is a sectional view showing a sliding contact projection portion.
Figure 10:
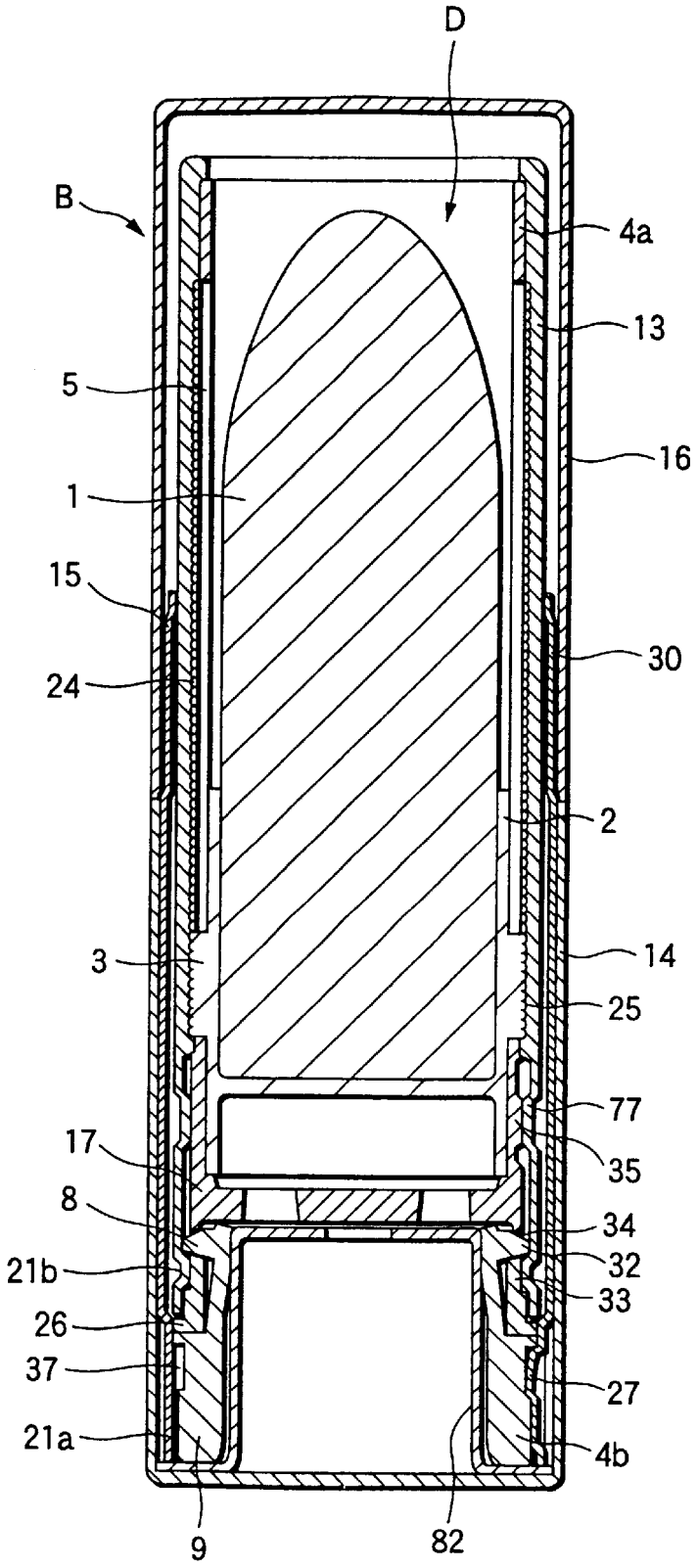
FIG. 10 is a sectional view showing a stick-shaped cosmetic screw-out container utilizing another embodiment of a sleeve.

The Reference Numerals and Signs used in the drawings are as set forth below.

| | |
|---|---|
| 1 | stick-shaped cosmetic |
| 2 | holding cylinder |
| 3 | screwing projection |
| 4 | shell cylinder |
| 4a | upper shell cylinder |
| 4b | lower shell cylinder |
| 5 | guide groove |
| 8 | inserting portion |
| 13 | sleeve |
| 14 | body cylinder |
| 15 | fitting cylinder |
| 16 | cap |
| 17 | diameter increasing portion |
| 21a | longitudinal rib |
| 21b | inner peripheral rib |
| 24 | spiral knurling tool |
| 25 | screwing surface |
| 27 | engagement projection |
| 29 | spiral groove |
| 30 | fitting portion |
| 32 | hook |
| 33 | engagement concave portion |
| 34 | window portion |
| 35 | sliding contact projection |
| 37 | concave groove |
| 74 | dent |
| 77 | sliding contact portion |
| 82 | drop-out preventing member |
| 83 | cam portion |

DETAILED DESCRIPTION OF THE INVENTION

An embodiment of the invention will be described in detail with reference to the drawings. A holding cylinder 2 fitting and holding a stick-shaped cosmetic 1 is provided with a screwing projection 3 on a side wall. The screwing projection 3 is provided at two places in opposite positions to each other.

The holding cylinder 2 is provided in an upper shell cylinder 4*a* vertically slidably. A guide groove 5 is provided in a parallel with an axis on the side wall of the upper shell cylinder 4*a*. The guide groove 5 through which the screwing projection 3 of the holding cylinder 2 penetrates serves to guide the holding cylinder 2 vertically slidably and unrotatably. A plurality of sliding contact projections 35 are provided from the lower portion of the guide groove 5. The sliding contact projections 35 are provided uniformly on the circumference of the upper shell cylinder 4*a*. Furthermore, a diameter increasing portion 17 having an outside diameter increased is provided under the sliding contact projection 35 and a slit-shaped window portion 34 is provided on the diameter increasing portion 17 in a horizontal direction. The window portion 34 is provided at two places in opposite positions on the circumference of the upper shell cylinder 4*a*. The amount of protrusion of the sliding contact projection 35 and the outside diameter of the diameter increasing portion 17 are almost equal to each other. A flange portion 26 is protruded from the lower end of the upper shell cylinder 4*a*.

An inserting portion 8 of a lower shell cylinder 4*b* is fitted in the lower end of the upper shell cylinder 4*a*. The inserting portion 8 has the shape of a pair of tongue pieces, and a hook 32 is protruded from the window portion 34 of the upper shell cylinder 4*a* to the outside over a side wall so that the upper shell cylinder 4*a* and the lower shell cylinder 4*b* are coupled to each other. Since the hook 32 has an upper surface tapered and a lower surface taking an acute angle, it can be inserted easily from below and is dropped out with difficulty. An engagement concave portion 33 is constituted under the hook 32. Moreover, one of ends of each hook 32 forms a cam portion 83 cut like a taper. When the lower shell cylinder 4*b* is rotated in the direction of the cam portion 83, the inserting portion 8 is bent inwardly by cam effects so that the amount of protrusion of the hook 32 can be decreased. A base portion 9 is protruded from the lower end of the upper shell cylinder 4*a* under the inserting portion 8. The base portion 9 has a cylindrical shape penetrating vertically and has a concave groove 37 provided on a side wall. A longitudinal rib 21*a* is provided over the whole periphery of the lower side wall of the concave groove 37.

A sleeve 13 is rotatably fitted in the upper shell cylinder 4*a*. A spiral groove 29 to which the screwing projection 3 of the holding cylinder 2 penetrating through the guide groove 5 of the shell cylinder 4 is provided on the inner wall of the sleeve 13. The spiral groove 29 is opened downward and the screwing projection 3 can be screwed thereto from below. Moreover, a sliding contact portion 77 with which the sliding contact projection 35 of the upper shell cylinder 4*a* comes in sliding contact with elasticity is protruded from the inner periphery under the spiral groove 29. As a result, when a rotation take-out (screw-out) operation is carried out, a relative rotation occurs between the shell cylinder 4 and the sleeve 13 so that a sliding resistance is generated between the sliding contact projection 35 and the sliding contact portion 77. Thus, a take-out operation feeling can be adjusted well. An inner peripheral rib 21*b* to be rotatably engaged with the engagement concave portion 33 of the shell cylinder 4 so as not to be dropped out is provided under the sliding contact portion 77. In such a state that the hook 32 of the lower shell cylinder 4*b* is protruded from the window portion 34, the shell cylinder 4 and the sleeve 13 are rotatably coupled to each other so as not to be dropped out and the inserting portion 8 of the lower shell cylinder 4*b* is deformed to pull in the hook 32 inwardly. In such a state that the engagement concave portion 33 is not provided, the sleeve 13 can be removed.

The holding cylinder 2, the shell cylinder 4 and the sleeve 13 constitute a structure portion D. Next, a container body B for removably attaching the structure portion D will be described. The container body B is constituted by the body cylinder 14, the fitting cylinder 15, the cap 16 and the drop-out preventing member 82.

The drop-out preventing member 82 is fixed to the bottom portion of the body cylinder 14. When the structure portion D is attached to the container body B, the drop-out preventing member 82 enters the lower shell cylinder 4*b* and is positioned on the back of the inserting portion 8 to prevent the inserting portion 8 from being deformed such that the sleeve 13 can be prevented from being dropped out carelessly.

Furthermore, the fitting cylinder 15 is fixed to the body cylinder 14. The fitting cylinder 15 is provided with a fitting portion 30 protruded from the upper end of the body cylinder 14 in which the cap 16 is removably fitted. The lower portion of the fitting cylinder 15 enters the body cylinder 14 and an inner wall thereof is provided with an engagement projection 27 to be engaged with the concave groove 37 and the longitudinal rib 21*b* in the lower shell cylinder 4*b* for unrotatably and removably holding the structure portion D so as not to be dropped out.

Since the invention has the structure described above, if the body cylinder 14 is held to rotate the sleeve 13 in the state in which the structure portion D is attached to the container body B, the shell cylinder 4 unrotatably engaged with the body cylinder 14 and the sleeve 13 are relatively rotated so that the screwing projection 3 of the holding cylinder 2 unrotatably penetrating through the guide groove 5 is screwed to the spiral groove 29 of the sleeve 13 to be rotated relatively. Therefore, the holding cylinder 2 vertically slides by the screwing action so that the stick-shaped cosmetic 1 is taken out.

In the case in which the stick-shaped cosmetic 1 is completely used and the container is to be scrapped, the container body B is held to take out the structure portion D. When the sleeve 13 of the structure portion D is held to rotate the lower shell cylinder 4*b* in the direction of the cam portion 83 of the hook 32, the hook 32 is pulled in by the cam portion 83 through the window portion 34 of the upper shell cylinder 4*a* and the inner peripheral rib 21*b* of the sleeve 13 is disengaged from the engagement concave groove 37 so that the sleeve 13 can be removed from the shell cylinder 4. The holding cylinder 2, the shell cylinder 4 and the sleeve 13 can be disassembled and scrapped separately.

In the case in which the invention is to be carried out, the number of the screwing projections 3 of the holding cylinder 2 is not restricted to two but may be one or two or more. In this case, the screwing projection 3 should be provided uniformly on the circumference of the holding cylinder 2 and the number of the guide grooves 5 to be provided and that of the spiral grooves 29 to be provided should correspond to the number of the screwing projections 3, respectively.

Moreover, it is desirable that the number of the sliding contact projections 35 of the upper shell cylinder 4*a* should be three or more in order to make the shell cylinder 4 coincident with the rotary shaft of the sleeve 13. Also in this case, it is necessary to uniformly provide the sliding contact projections 35 on the circumference of the upper shell cylinder 4*a*. Furthermore, the periphery of at least one portion of the sliding contact projection 35 is thinned to provide a dent 74 and to adjust elasticity. Consequently, the degree of the sliding contact of the shell cylinder 4 and the sleeve 13 can be regulated so that the rotation take-out operation feeling can be adjusted slightly.

While the structure in which the sliding contact projection 35 is provided has been described for such a structure that a sliding resistance is given to the rotation take-out operation feeling, a well-known sliding resistance giving mechanism utilizing an O ring can also be embodied. In this case, the outside diameter of the O ring should be made almost coincident with the outside diameter of the diameter increasing portion 17 of the upper shell cylinder 4*a* and the sliding contact portion 77 should be protruded from the inner wall of the sleeve 13 to bring the O ring in sliding contact therewith.

Moreover, while the structure in which the number of the screwing projections 3 of the holding cylinder 2 is coincident with the number of the spiral grooves 29 of the sleeve 13 has been described, it is also possible to replace the spiral groove 29 of the sleeve 13 with the spiral knurling tool 24 having countless shallow and fine grooves over the whole periphery of the inner wall and to screw the screwing projection 3 to the spiral knurling tool 24. In this case, the spiral knurling tools 24 adjacent to each other are screwed to a screwing surface 25 of the screwing projection 3. As a result, one screwing projection 3 is screwed to a plurality of spiral grooves. Therefore, it is possible to cause a backlash to approximate to almost zero through the screwing and to eliminate the looseness of the holding cylinder 2, thereby preventing the stick-shaped cosmetic 1 from being damaged. Since one screwing projection 3 is screwed to the spiral grooves, it is possible to lessen the amount of catch of the screwing projection 3 on one spiral groove. Therefore, the thickness of the sleeve 13 can be reduced so that the outside diameter of the sleeve 13 can be smaller than that of the accommodated stick-shaped cosmetic 1. The spiral stripe is provided over the whole periphery of the inner wall of the sleeve 13. Consequently, it is not necessary to carry out alignment when screwing the screwing projection 3 of the holding cylinder 2 so that a great deal of time and labor can be saved. It is not necessary to carry out the alignment when screwing the screwing projection 3 of the holding cylinder 2. Therefore, there is an advantage that an assembly can be automated easily.

Moreover, while the structure in which the drop-out preventing member 82 is fixed into the body cylinder 14 separately from the body cylinder 14 and the fitting cylinder 15 has been described, it may be linked to the lower portion of the body cylinder 14 or the fitting cylinder 15.

According to the invention, as described above, the shell cylinder 4 is divided into the upper shell cylinder 4*a* and the lower shell cylinder 4*b* and the hook 32 of the upper shell cylinder 4*a* is protruded from the window portion 34 of the lower shell cylinder 4*b* so that the engagement concave portion 33 with which the inner peripheral rib 21*b* of the sleeve 13 is rotatably engaged is constituted. Therefore, if the hook 32 is not protruded from the window portion 34, the inner peripheral rib 21*b* of the sleeve 13 is not engaged but the sleeve 13 can be removed readily. For the method of retracting the hook 32 from the window portion 34, one of the end faces of the hook 32 is cut away to provide the cam portion 83 and the cam portion 83 is utilized. Therefore, if the lower shell cylinder 4*b* is rotated in the direction of the cam portion 83, the hook 32 can be retracted from the window portion 34 more easily by the action of the cam. Accordingly, women having less strength can fully carry out an operation.

In addition, in the state in which the structure portion D is attached to the container body B, the drop-out preventing member 82 fixed into the body cylinder 4 enters the lower shell cylinder 4*b* and is positioned on the back of the hook 32. Therefore, it is possible to prevent the hook 32 from being retracted into the window portion 34. In this state, the sleeve 13 is so set as not to be removed from the shell cylinder 4. Accordingly, even if the sleeve 13 is pulled to disassemble the container, the structure portion D can be disengaged from the container body B without dropping out the sleeve 13. In the single structure portion D, furthermore, the inserting portion 8 having the hook 32 protruded therefrom can be bent and the hook 32 can be retracted from the window portion 34 easily as described above. Thus, the sleeve 13 can be disassembled.

We claim:

1. A stick-shaped cosmetic screw-out container comprising:

a holding cylinder fitting and holding a stick-shaped cosmetic and having a screwing projection provided from a side wall;

a shell cylinder including the holding cylinder vertically slidably, having a guide groove through which the screwing projection penetrates provided on a side wall and having an engagement concave portion provided on a lower side wall;

a sleeve fitted in the shell cylinder, having a screwing groove for screwing the screwing projection provided on an inner wall and having, on a lower inner wall, an inner peripheral rib engaged rotatably with the engagement concave portion so as not to be dropped out;

a body cylinder for holding a lower portion of the shell cylinder so as not to be dropped out; and a fitting cylinder fixed onto the body cylinder and provided with a fitting portion in which a cap is removably fitted, wherein at least one of the holding cylinder, the shell cylinder and the sleeve is formed of a different material;

the lower portion of the shell cylinder is connected to the body cylinder unrotatably and removably so as not to be dropped out;

the shell cylinder is divided into an upper shell cylinder and a lower shell cylinder;

the upper shell cylinder is provided with the guide groove;

a diameter increasing portion having an outside diameter increased is provided in a lower portion;

a pair of window portions are provided in the vicinity of a lower end in a horizontal direction;

a tongue piece-shaped inserting portion to enter from the lower end of the upper shell cylinder is linked to the lower shell cylinder;

a hook is protruded from the window portion to an outside over a side wall of a tip portion of the inserting portion; and one of end faces of the hook is cut like a taper to constitute a cam portion, and in such a state that the hook is protruded from the window portion of the upper shell cylinder, the engagement concave portion is formed under the hook, and the hook is retracted into the window portion by the cam portion of the hook and is disengaged from the engagement concave portion when the upper shell cylinder and the lower shell cylinder are rotated relatively in a direction of the cam portion.

2. The stick-shaped cosmetic screw-out container according to claim 1, wherein a concave groove is provided over a side wall of the lower shell cylinder, a longitudinal rib is provided over a whole periphery of a lower side wall of the concave groove, and an inner wall of the body cylinder or an inside wall of a lower portion of the fitting cylinder is provided with an engagement projection engaged with the concave groove and the longitudinal rib for engaging the shell cylinder and the body cylinder unrotatably and removably so as not to be dropped out.

3. The stick-shaped cosmetic screw-out container according to claim 1, wherein there is fixed a drop-out preventing member which is a cylindrical body penetrating through the lower shell cylinder vertically and enters the lower shell cylinder to be positioned on a back of the inserting portion, thereby inhibiting the inserting portion from being deformed and preventing a retraction into the window portion of the hook in such a state that the shell cylinder is connected to the body cylinder.

4. The stick-shaped cosmetic screw-out container according to claim 1, wherein countless spiral stripes having a smaller width than that of the screwing projection are provided over a whole periphery of an inner wall of the sleeve to constitute a spiral knurling tool and a screwing surface of the screwing projection of the holding cylinder is screwed to the adjacent spiral stripes.

5. The stick-shaped cosmetic screw-out container according to claim 1, wherein a plurality of sliding contact projections protruded to have diameters almost equal to the diameter increasing portion are provided uniformly on an outer peripheral wall between the guide groove of the upper shell cylinder and the diameter increasing portion, and the inner wall of the sleeve is provided with a sliding contact portion on which the sliding contact portions abut with elasticity.

6. The stick-shaped cosmetic screw-out container according to claim 5, wherein a peripheral thickness of at least one of the sliding contact projections is decreased to constitute a dent and a depth of the dent is increased or decreased, thereby regulating elasticity with which the sliding contact portions abut on the sliding contact portion of the sleeve and adjusting a screw-out operation feeling.

7. A stick-shaped cosmetic screw-out container comprising:

a means for fitting and holding a stick-shaped cosmetic and having a screwing projection provided from a side wall;

a shell cylinder including the means for fitting vertically slidably, having a guide groove through which the screwing projection penetrates provided on a side wall and having an engagement concave portion provided on a lower side wall;

a sleeve fitted in the shell cylinder, having a screwing groove for screwing the screwing projection provided on an inner wall and having, on a lower inner wall, an inner peripheral rib engaged rotatably with the engagement concave portion so as not to be dropped out;

a body cylinder for holding a lower portion of the shell cylinder so as not to be dropped out; and a fitting cylinder fixed onto the body cylinder and provided with a fitting portion in which a cap is removably fitted, wherein at least one of the means for holding, the shell cylinder and the sleeve is formed of a different material;

the lower portion of the shell cylinder is connected to the body cylinder unrotatably and removably so as not to be dropped out;

the shell cylinder is divided into an upper shell cylinder and a lower shell cylinder;

the upper shell cylinder is provided with the guide groove;

a diameter increasing portion having an outside diameter increased is provided in a lower portion;

a pair of window portions are provided in the vicinity of a lower end in a horizontal direction;

a tongue piece-shaped inserting portion to enter from the lower end of the upper shell cylinder is linked to the lower shell cylinder;

a hook is protruded from the window portion to an outside over a side wall of a tip portion of the inserting portion; and one of end faces of the hook is cut like a taper to constitute a cam portion, and in such a state that the hook is protruded from the window portion of the upper shell cylinder, the engagement concave portion is formed under the hook, and the hook is retracted into the window portion by the cam portion of the hook and is disengaged from the engagement concave portion when the upper shell cylinder and the lower shell cylinder are rotated relatively in a direction of the cam portion.

8. The stick-shaped cosmetic screw-out container according to claim 7, wherein a concave groove is provided over a side wall of the lower shell cylinder, a longitudinal rib is provided over a whole periphery of a lower side wall of the concave groove, and an inner wall of the body cylinder or an inside wall of a lower portion of the fitting cylinder is provided with an engagement projection engaged with the concave groove and the longitudinal rib for engaging the shell cylinder and the body cylinder unrotatably and removably so as not to be dropped out.

9. The stick-shaped cosmetic screw-out container according to claim 7, wherein there is fixed a drop-out preventing member which is a cylindrical body penetrating through the lower shell cylinder vertically and enters the lower shell cylinder to be positioned on a back of the inserting portion, thereby inhibiting the inserting portion from being deformed and preventing a retraction into the window portion of the hook in such a state that the shell cylinder is connected to the body cylinder.

10. The stick-shaped cosmetic screw-out container according to claim 7, wherein countless spiral stripes having a smaller width than that of the screwing projection are provided over a whole periphery of an inner wall of the sleeve to constitute a spiral knurling tool and a screwing surface of the screwing projection of the means for filling is screwed to the adjacent spiral stripes.

11. The stick-shaped cosmetic screw-out container according to claim 7, wherein a plurality of sliding contact projections protruded to have diameters almost equal to the diameter increasing portion are provided uniformly on an outer peripheral wall between the guide groove of the upper shell cylinder and the diameter increasing portion, and the inner wall of the sleeve is provided with a sliding contact portion on which the sliding contact portions abut with elasticity.

12. The stick-shaped cosmetic screw-out container according to claim 11, wherein a peripheral thickness of at least one of the sliding contact projections is decreased to constitute a dent and a depth of the dent is increased or decreased, thereby regulating elasticity with which the sliding contact portions abut on the sliding contact portion of the sleeve and adjusting a screw-out operation feeling.

13. A stick-shaped cosmetic screw-out container comprising:

a holding cylinder fitting and holding a stick-shaped cosmetic and having a screwing projection provided from a side wall;

a shell cylinder including the holding cylinder vertically slidably, having a guide groove through which the screwing projection penetrates provided on a side wall and having an engagement concave portion provided on a lower side wall;

a sleeve fitted in the shell cylinder, having a screwing groove for screwing the screwing projection provided on an inner wall and having, on a lower inner wall, an inner peripheral rib engaged rotatably with the engagement concave portion so as not to be dropped out;

a body cylinder for holding a lower portion of the shell cylinder so as not to be dropped out; and a fitting cylinder fixed onto the body cylinder and provided with a fitting portion in which a cap is removably fitted, wherein at least one of the holding cylinder, the shell cylinder and the sleeve is formed of a different material;

the lower portion of the shell cylinder is connected to the body cylinder unrotatably and removably so as not to be dropped out;

the shell cylinder is divided into an upper shell cylinder and a lower shell cylinder;

the upper shell cylinder is provided with the guide groove;

a diameter increasing portion having an outside diameter increased is provided in a lower portion;

a pair of window portions are provided in the vicinity of a lower end in a horizontal direction;

a tongue piece-shaped inserting portion to enter from the lower end of the upper shell cylinder is linked to the lower shell cylinder;

a hook is protruded from the window portion to an outside over a side wall of a tip portion of the inserting portion; and one of end faces of the hook is cut like a taper to constitute a cam portion, and in such a state that the hook is protruded from the window portion of the upper shell cylinder, the engagement concave portion is formed under the hook, and the hook is retracted into the window portion by the cam portion of the hook and is disengaged from the engagement concave portion when the upper shell cylinder and the lower shell cylinder are rotated relatively in a direction of the cam portion, wherein the stick-shaped cosmetic screw-out container is disassembled easily.

14. The stick-shaped cosmetic screw-out container according to claim 13, wherein a concave groove is provided over a side wall of the lower shell cylinder, a longitudinal rib is provided over a whole periphery of a lower side wall of the concave groove, and an inner wall of the body cylinder or an inside wall of a lower portion of the fitting cylinder is provided with an engagement projection engaged with the concave groove and the longitudinal rib for engaging the shell cylinder and the body cylinder unrotatably and removably so as not to be dropped out.

15. The stick-shaped cosmetic screw-out container according to claim 13, wherein there is fixed a drop-out preventing member which is a cylindrical body penetrating through the lower shell cylinder vertically and enters the lower shell cylinder to be positioned on a back of the inserting portion, thereby inhibiting the inserting portion from being deformed and preventing a retraction into the window portion of the hook in such a state that the shell cylinder is connected to the body cylinder.

16. The stick-shaped cosmetic screw-out container according to claim 13, wherein countless spiral stripes having a smaller width than that of the screwing projection are provided over a whole periphery of an inner wall of the sleeve to constitute a spiral knurling tool and a screwing surface of the screwing projection of the holding cylinder is screwed to the adjacent spiral stripes.

17. The stick-shaped cosmetic screw-out container according to claim 13, wherein a plurality of sliding contact projections protruded to have diameters almost equal to the diameter increasing portion are provided uniformly on an outer peripheral wall between the guide groove of the upper shell cylinder and the diameter increasing portion, and the inner wall of the sleeve is provided with a sliding contact portion on which the sliding contact portions abut with elasticity.

18. The stick-shaped cosmetic screw-out container according to claim 17, wherein a peripheral thickness of at least one of the sliding contact projections is decreased to constitute a dent and a depth of the dent is increased or decreased, thereby regulating elasticity with which the sliding contact portions abut on the sliding contact portion of the sleeve and adjusting a screw-out operation feeling.

19. The stick-shaped cosmetic screw-out container according to claim 13, wherein the stick-shaped cosmetic screw-out container is scraped separately.

20. The stick-shaped cosmetic screw-out container according to claim 13, wherein the stick-shaped cosmetic screw-out container is prevented from being disassembled carelessly during use.

* * * * *